US005255411A

United States Patent [19]

Da Costa

[11] Patent Number: 5,255,411

[45] Date of Patent: Oct. 26, 1993

[54] LIFT-OFF MECHANISM FOR AN UPRIGHT VACUUM CLEANER

[75] Inventor: Philip M. Da Costa, Oakville, Canada

[73] Assignee: Iona Appliances Inc., Welland, Canada

[21] Appl. No.: 822,239

[22] Filed: Jan. 17, 1992

[30] Foreign Application Priority Data

Jul. 29, 1991 [CA] Canada ..... 2048098

[51] Int. Cl.[5] ..... A47L 5/34

[52] U.S. Cl. ..... 15/333; 15/361

[58] Field of Search ..... 15/332-334, 15/354, 361

[56] References Cited

U.S. PATENT DOCUMENTS

| | | | |
|---|---|---|---|
| 2,022,438 | 11/1935 | Schwarz | 15/361 |
| 2,024,260 | 12/1935 | White . | |
| 2,070,689 | 2/1937 | Smellie . | |
| 2,103,101 | 12/1937 | Taylor . | |
| 2,174,560 | 10/1939 | Becker . | |
| 2,300,204 | 10/1942 | Carlson . | |
| 2,334,364 | 11/1943 | Vavrik et al. | 15/354 |
| 2,389,877 | 11/1945 | Snyder . | |
| 2,485,363 | 10/1949 | Coss | 15/361 |
| 2,606,337 | 8/1952 | Balluff | 15/337 |
| 2,644,976 | 7/1953 | Osborn | 15/333 |
| 2,653,343 | 9/1953 | Kunkler | 15/333 |
| 2,677,845 | 5/1954 | Daiger | 15/333 |
| 2,686,331 | 8/1954 | Humphrey | 15/333 |
| 2,730,752 | 1/1956 | Seck | 15/361 |
| 2,734,216 | 2/1956 | Brace | 15/333 |
| 2,734,219 | 2/1956 | Kaufman | 15/361 |
| 2,747,215 | 5/1956 | Segesman | 15/333 |
| 3,579,699 | 5/1971 | Balzer | 15/361 |
| 3,676,892 | 7/1972 | Nordeen | 15/333 |
| 3,908,223 | 9/1975 | Brooks et al. | 15/361 |
| 4,446,594 | 5/1984 | Watanabe et al. . | |
| 4,782,552 | 11/1988 | Bartlett et al. | 15/361 |
| 4,823,429 | 4/1989 | Petralia | 15/361 |
| 4,823,430 | 4/1989 | Yonkers et al. | 15/361 |
| 5,042,109 | 8/1991 | Stephens | 15/354 |

FOREIGN PATENT DOCUMENTS

| | | | |
|---|---|---|---|
| 952663 | 8/1974 | Canada | 15/354 |
| 960816 | 1/1975 | Canada . | |
| 626014 | 2/1936 | Fed. Rep. of Germany . | |
| 936951 | 12/1955 | Fed. Rep. of Germany | 15/361 |
| 79100830 | 11/1983 | Sweden . | |
| 372804 | 12/1963 | Switzerland | 15/361 |
| 296978 | 9/1929 | United Kingdom . | |
| 706144 | 3/1954 | United Kingdom . | |
| 1154045 | 6/1969 | United Kingdom | 15/361 |

OTHER PUBLICATIONS

Spare Parts List—Upright Cleaner 610, Edition 1, Dec., 1985, Electrolux Ltd.

Spare Parts List (with prices)—Upright Cleaner 2610, Edition 2, Nov., 1987.

Spare Parts List—Upright Cleaner "Electronic" 2612E, Edition 3, Feb., 1989, Electrolux Ltd.

*Primary Examiner*—Timothy F. Simone
*Assistant Examiner*—Mark Spisich
*Attorney, Agent, or Firm*—Bereskin & Parr

[57] ABSTRACT

A vacuum cleaner comprises a base which has a surface cleaning nozzle and a wheel housing which is moveable between a raised position and a lowered position. Wheels are rotatably mounted on the wheel housing. An abutment arm is attached to said wheel housing at a fixed position relative to said wheels. A handle structure is pivotally mounted on the base and moveable between an upper storage position and a lower operating position. A protrusion, which is attached to the handle, structure, is positioned and ad to engage the abutment arm. A spring is provided which bias the wheel housing to its raised position. As the handle structure is pivoted from the lower operating position to the upper storage position, the abutment arm engages the protrusion moving said wheel housing to its lower position and consequently raising said nozzle.

2 Claims, 4 Drawing Sheets

LIFT-OFF MECHANISM FOR AN UPRIGHT VACUUM CLEANER

FIELD OF THE INVENTION

The present invention relates to a means for automatically lowering the surface cleaning nozzle of an upright vacuum cleaner when the handle is moved from an upper storage position to a lower operating position and automatically raising the surface cleaning nozzle when the handle is returned to the storage position.

BACKGROUND TO THE INVENTION

Upright vacuum cleaners comprise a base having a surface cleaning nozzle and a handle portion which contains dust separation and storage means. Typically, the dust separation and storage means comprises a paper and/or cloth filter bag. However, more recently, upright vacuum cleaners using cyclonic dust separation and storage means have been developed.

Upright vacuum cleaners typically have a rotating brush which is positioned above the surface cleaning nozzle. The bristles of the rotating brush extend downwardly so as to contact the surface, typically a carpet, which is to be cleaned.

The handle of an upright vacuum cleaner is typically operable between an upper storage position and a lower operating position. Numerous upright vacuum cleaners include or are adapted to receive extension hoses so that the upright vacuum cleaner may also be operated as an above-floor vacuum cleaner. When an upright vacuum cleaner is operated in the above-floor mode, the handle is typically locked in the upper storage position. Accordingly, in order to avoid damage to the carpet when the vacuum cleaner is used in the above-floor mode, either the rotating brush must be disengaged from the motor or the surface cleaning nozzle must be raised above the carpet.

Upright vacuum cleaners may include height adjustment means. Such means are used to adjust the height of the nozzle of a vacuum cleaner to two or more positions above the surface to be cleaned.

SUMMARY OF THE INVENTION

It is an object of the present invention to provide a simplified lift-off mechanism by which the surface cleaning nozzle is lowered to an operating position automatically as the handle of an upright vacuum cleaner is pivoted from its upper storage position to its lower operating position.

It is a further object of the instant invention to provide a simplified lift-off mechanism which may be used in conjunction with a height adjustment mechanism so that, when the handle is pivoted from the upper storage position to the lower operating position, the nozzle is lowered to a position above the surface to be cleaned which is predetermined by the operator of the vacuum cleaner.

According to the instant invention, a vacuum cleaner comprises a base having a surface cleaning nozzle and a wheel housing moveable between a raised position and a lowered position in each of which positions the surface cleaning nozzle is respectively lowered and raised above the surface to be cleaned; wheel means rotatably mounted on the wheel housing; first abutment means attached to the wheel housing and fixed in position relative to the wheel means; a handle structure pivotally mounted on the base and moveable between an upper storage position and a lower operating position; second abutment means attached to the handle structure, the second abutment means positioned and adapted to engage the first abutment means and to move said wheel housing between said raised and lowered positions; and, spring means biasing the wheel housing to the raised position whereby, as the handle is pivoted from the lower operating position to the upper storage position, the second abutment means engages the first abutment means moving the wheel housing from the raised position to the lowered position thus raising the surface cleaning nozzle.

According to a preferred embodiment of the instant invention, the handle structure has a lower portion which comprises a cylindrical housing. The second abutment means comprises at least one protrusion which is attached to the peripheral surface of the cylindrical housing. The wheel housing has a lower portion and an upper portion. The wheel means is rotatably mounted on the lower portion of the wheel housing. The upper portion comprises a support platform which is mounted at a predetermined position above the lower portion by a plurality of supports. At least, one abutment arm is attached to the support platform and extends substantially vertically therefrom. The wheel housing is located near the handle structure so that the at least one abutment arm engages the at least one protrusion as the handle structure pivots from the lower operating position to the upper storage position.

DETAILED DESCRIPTION OF THE PREFERRED EMBODIMENT

The present invention will be more fully and completely explained in connection with the following description of the preferred embodiment and the accompanying FIGS. in which.

Figure 1:
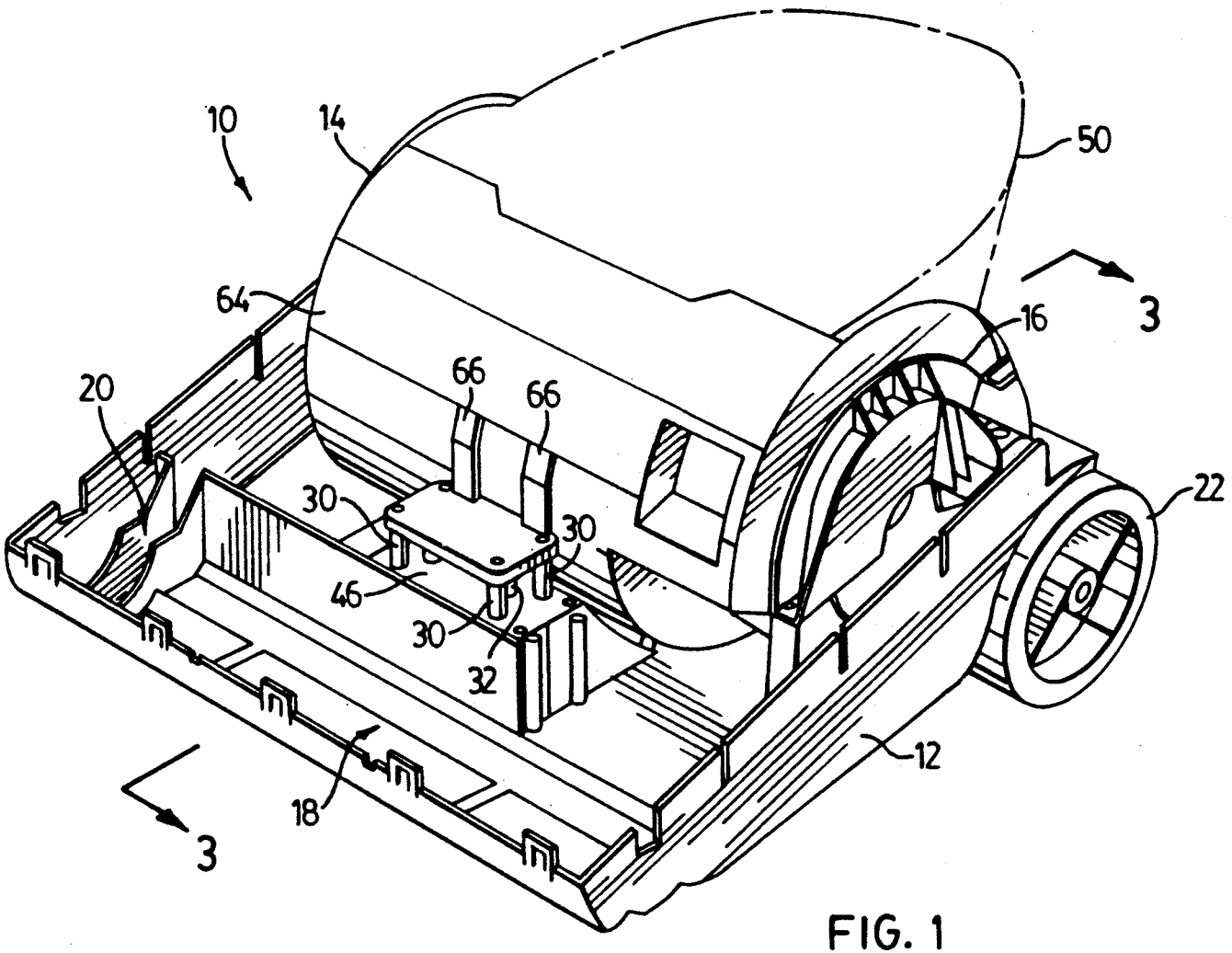
FIG. 1 is a perspective view from above of the preferred embodiment of the instant invention.
Figure 2:
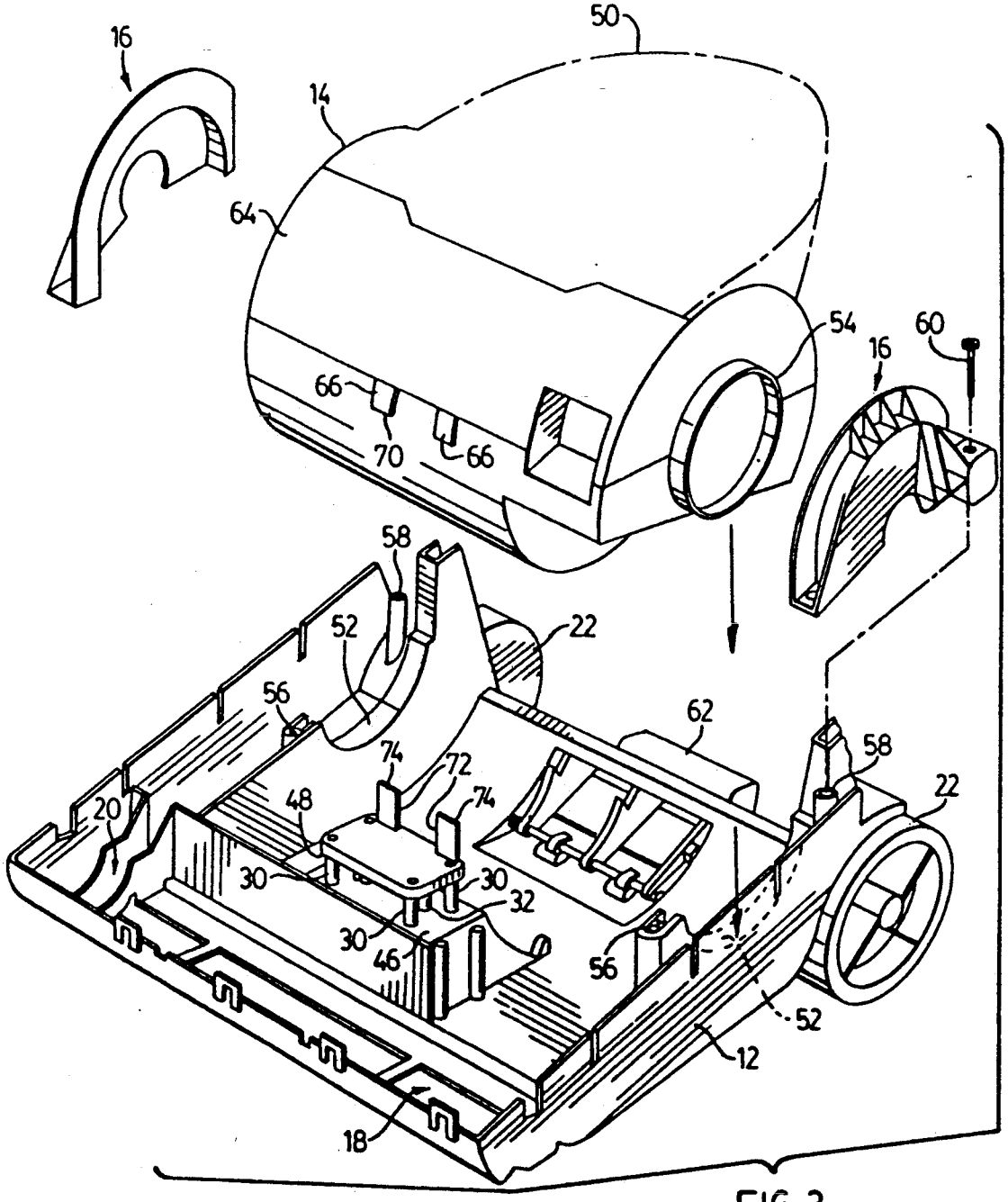
FIG. 2 is a partial exploded view of the device of FIG. 1.

Referring first to FIGS. 1 and 2, the lower portion of vacuum cleaner 10 comprises base 12, housing 14 and two upper pivot mounts 16.

Base 12 may be of any design known in the art of upright vacuum cleaners. As shown in FIG. 2, base 12 is an integrally moulded unit having surface cleaning nozzle 18. Surface cleaning nozzle 18 is located at the front end of base 12. Base 12 is designed to allow a rotating brush (not shown) to be rotatably mounted above surface cleaning nozzle 18. Channel 20 is located to one side of the front end of base 12. Channel 20 is designed and positioned to accept a drive belt which operatively drives the rotating brush when the rotating brush is rotatably mounted on base 12.

In order to allow the vacuum cleaner to be pushed by the operator, base 12 is provided with wheels near the front and the rear of base 12. Rear wheels 22 are rotatably mounted at the rear of base 12. Front wheels 24 are rotatably mounted on base 12 immediately behind surface cleaning nozzle 18.

Figure 3:
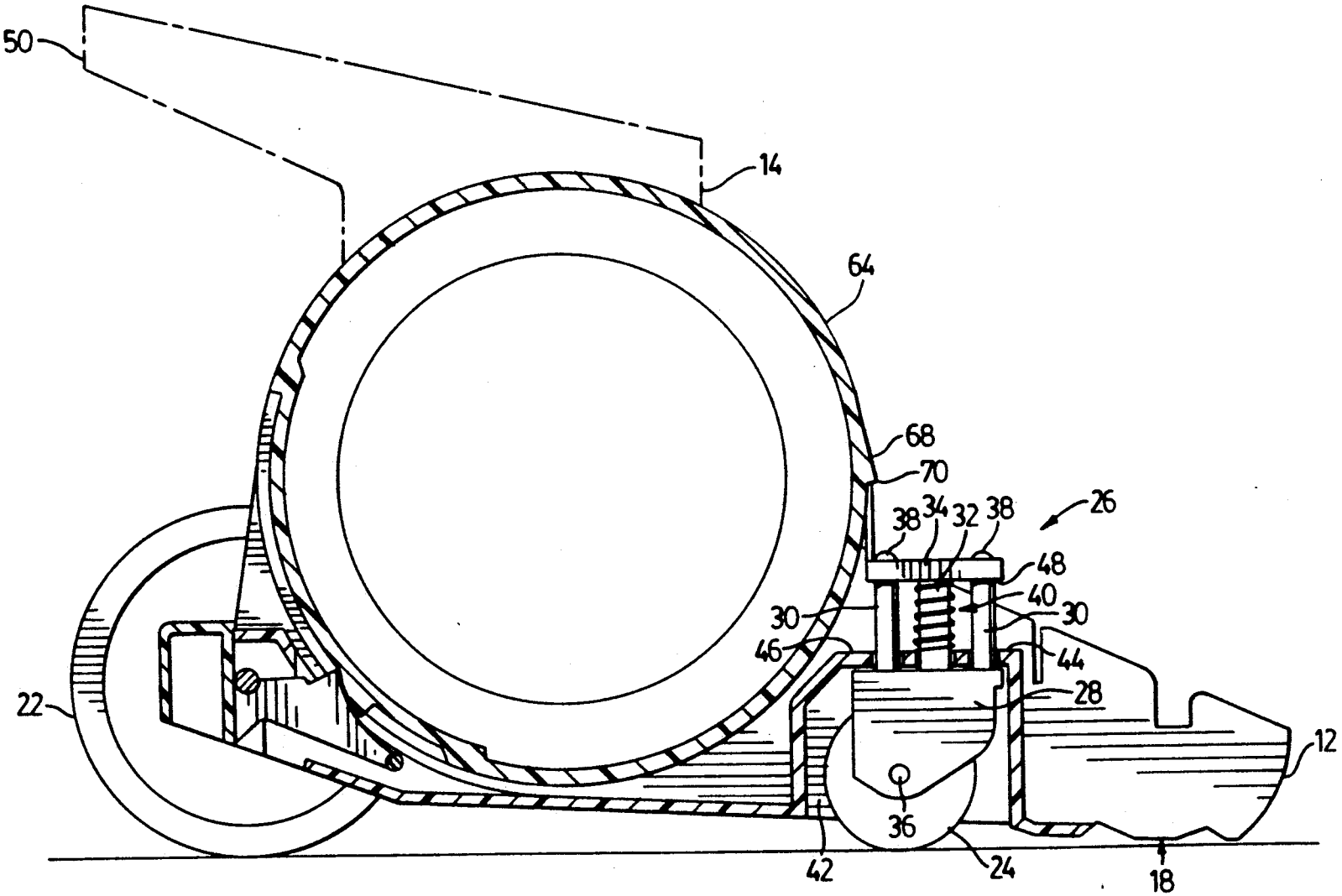
FIG. 3 is a cross-section through line 3—3 of FIG. 1 wherein the surface cleaning nozzle is in the lowered position.
Figure 4:
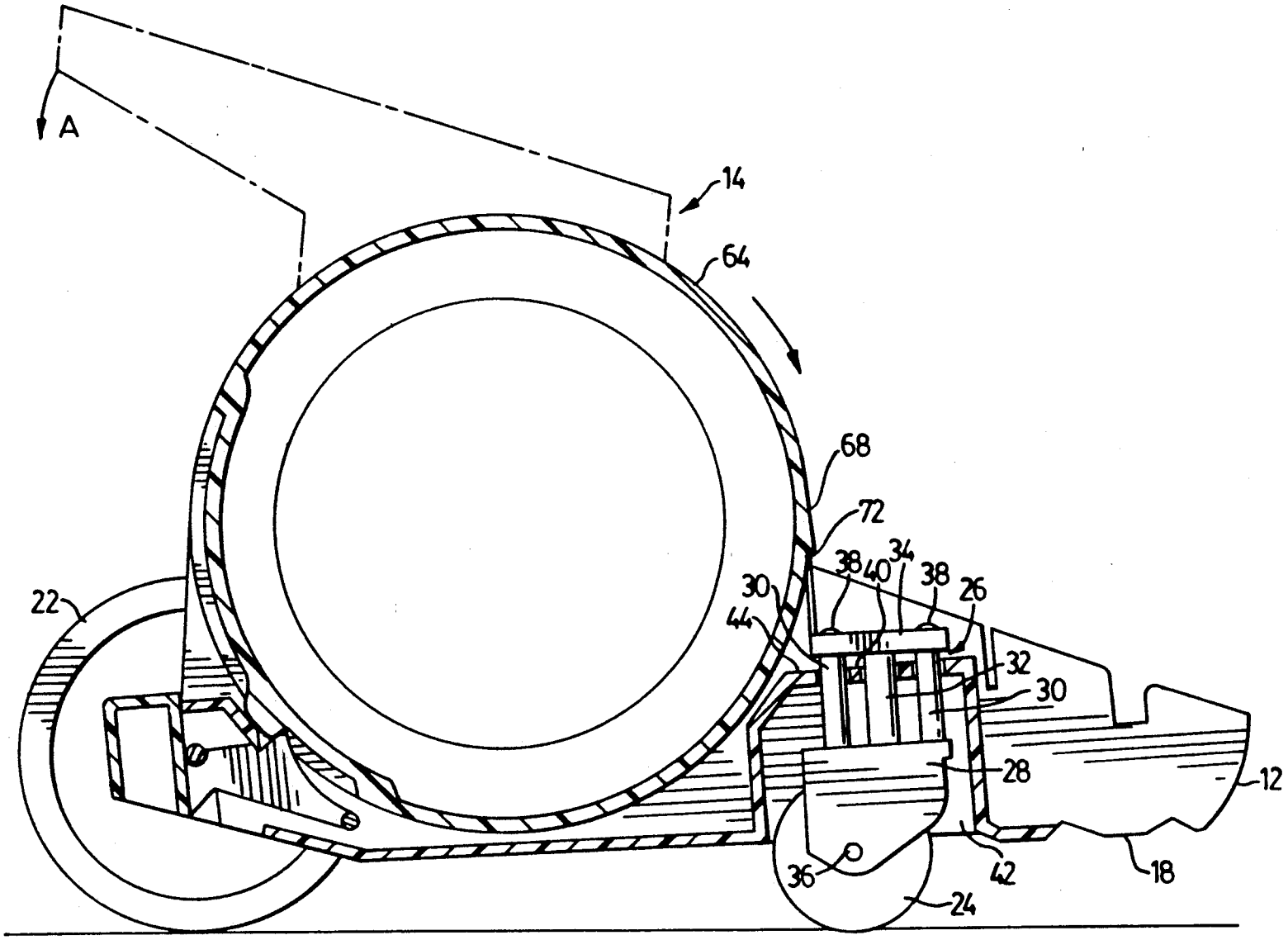
FIG. 4 is a cross-section through line 3—3 of FIG. 1 wherein the surface cleaning nozzle is in the raised position.

Front wheels 24 are mounted on base 12 by means of wheel housing 26. Wheel housing 26 comprises lower portion 28, exterior supports 30, interior supports 32 and support platform 34. Front wheels 24 are rotatably mounted on lower portion 28 by means of axle 36. Support platform 34 is mounted above lower portion 28 by means of exterior supports 30. As shown in FIGS. 3 and 4, according to the preferred embodiment, four exterior supports are provided, each located near one of the four corners of support platform 34. Exterior supports 30 are fixedly attached to both lower portion 28 and support platform 34. In the preferred embodiment, exterior supports 30 are integrally formed as part of lower portion 28 and they are fixedly attached to support platform 34 by means of screws 38. The design and positioning of support platform 34 and exterior supports 30 is discussed further below.

Two interior supports 32 are provided between the front pair of exterior supports 30 and the rear pair of exterior supports 30. Interior supports 32 are located near each side of support platform 34. A spring 40 surrounds each interior support 32.

Base 12 is provided with a recess 42 immediately behind surface cleaning nozzle 18. Recess 42 has a top surface 44. Top surface 44 is provided with 6 holes. Each of these holes is positioned and shaped so as to receive a respective exterior support 30 or interior support 32.

As shown in the drawings, the upper side of top surface 44 of recess 42 is denoted by numeral 46. Similarly, the lower side of support platform 34 is denoted by reference numeral 48. Each spring 40 is positioned on its respective interior support 32 between upper side 46 and lower side 48. In this position, springs 40 bias wheel housing 26 into the raised position which is shown in FIG. 3.

Housing 14 comprises the lower end of a handle structure (not shown). Housing 14 has rear portion 50 which is shown in dashed outline. A handle assembly, which may include a mechanism for separating the dust and entrained dirt from the air and the storage compartment for the dust and separated entrained dirt may be attached to housing 14 as an extension of the housing. Housing 14 is pivotally attached to base 12 by means of upper pivot mounts 16, lower pivot mounts 52 and pivots 54. Each side of housing 14 is provided with a pivot 54.

As shown in FIG. 2, lower pivot mounts 52 are formed as part of base 12. Lower pivot mounts 52 are provided near each side of base 12 towards the rear thereof. Each upper pivot mount 16 is attached to base 12 by means of a front upper pivot mount support 56 and a rear upper pivot mount support 58. Each pair of front upper pivot mount support and rear upper pivot mount support is located adjacent a respective lower pivot mount 52. Upper pivot mount 16 is attached to said front and rear upper pivot mount supports by means of screws 60. The front and rear upper pivot mount supports are positioned so that, when upper pivot mount 16 is attached thereto, upper pivot mount 16 and lower pivot mount 52 provide a substantially circular surface sized to receive respective pivot 54.

By this design, housing 14 is pivotally mounted on base 12 between an upper storage position, as shown in FIG. 4, and a lower operating position (not shown). When the handle, and the housing, is pivoted from the storage position to the operating position, the handle, and housing 14, rotate in the direction of arrow A as shown in FIG. 4. Housing 14 may be secured in the upper storage position by any means known in the art. Preferably, a foot operated peddle 62 is provided to permit the handle to be easily released from its storage position and pivoted into an operating position.

According to the preferred embodiment, housing 14 is sized to receive the motor for the upright vacuum cleaner. Due to this design, housing 14 has a vacuum inlet port which is connected to surface cleaning nozzle 18 (not shown). In addition, housing 14 has a vacuum outlet port which connects to the filter mechanism of the upright vacuum cleaner (not shown). Accordingly, housing 14 is provided with a cylindrical peripheral surface 64.

Housing 14 is provided with an abutment means which comprises two protrusions 66 which are located on the front portion of peripheral surface 64. The protrusions are formed integrally as part of peripheral surface 64 and have a surface 68 which extends outwardly and downwardly from peripheral surface 64. Each protrusion 66 also has a lower surface 70 which is substantially flat. The outer surface of housing 14 need not be solid provided that a surface which pivots with the housing is provided to which the abutment means may be attached.

Wheel housing 26 is also provided with an abutment means. According to the preferred embodiment, support platform 34 is provided with two abutment arms 72. Each of the abutment arms is located at one side of the rear portion of support surface 34. Each abutment arm extends substantially vertically upwardly from support platform 34 and has an upper surface 74 which is substantially flat. Abutment arms 72 and protrusions 66 are sized and positioned so that each protrusion 66 engages an abutment arm 72 as the handle of the upright vacuum cleaner is pivoted from an operating position to the storage position which is shown in FIG. 4. The protrusions and the abutment arms are positioned and sized so that, when the handle of the operating vacuum cleaner is in the upright storage position shown in FIG. 4, protrusions 66 force wheel housing 26 into its lowered position by their interaction with abutment arms 72. It will be understood to those skilled in the art that protrusions 66 and abutment arms 72 may be affixed to their respective part of the housing and the wheel housing by any suitable means and that their shape and size may be varied to provide the above-described interaction between the two abutment means. As will be apparent, due to this structure, support platform 34 and exterior supports 30 are sized and positioned to accept the downward force from protrusions 66 so that wheel housing 26 is forced into its lowered position by the pivoting of housing 14.

In operation, when the upright vacuum cleaner is moved into an operating position, housing 14 will be rotated in the direction shown by arrow A in FIG. 4. When the housing 14 is in this position, protrusions 66 will not contact abutment arms 72. Accordingly, springs 40 will bias wheel housing 26 into its raised position which is shown in FIG. 3. When wheel housing 26 is in its raised position, front wheels 24 are raised and surface cleaning nozzle 18 is lowered towards the surface to be cleaned. When the operator has completed vacuuming the required area, or if it is desired to use the vacuum cleaner in the above-floor mode, then the handle, and accordingly housing 14, are pivoted towards the storage position. As housing 14 is pivoted, protrusions 66 will contact abutment arms 72 as the handle and housing 14 near the storage position. This position is shown in FIG. 3. As the handle continues to pivot into the storage position, protrusions 66 will depress abutment arms 72 until the handle is in the storage position which is shown in FIG. 4. As the handle and housing 14 pivot, support platform 34 is forced downwardly compressing springs 40. This movement lowers front wheels 24 which are in a fixed position relative to the support platform. As wheel housing 26 is moved to its lowered position, surface cleaning nozzle 18 is raised above the surface to be cleaned to the position shown in FIG. 4. In this position the vacuum cleaner may be placed in storage without damage to the floor. Alternatively, the vacuum cleaner may be used in an above-floor mode by means of a hose mechanism (not shown). As the vacuum cleaner is used in the above-floor mode, the bristles of the rotating brush may continue to rotate but will not damage the surface on which the vacuum cleaner is located due to the raised position of surface cleaning nozzle 18.

In some cases, it is desirable to control the height of surface cleaning nozzle 18 when the vacuum cleaner is in an operating position. Due to the construction of the wheel housing 26, a suitable height adjustment means may be added to the vacuum cleaner to interact with wheel housing 26 by adding a height adjustment knob which interacts with the upper surface of support platform 34.

I claim:

1. A vacuum cleaner comprising:

(i) a base having a surface cleaning nozzle and a wheel housing, said wheel housing having a lower contiguous portion and an upper contiguous portion, said upper portion of said wheel housing comprising a substantially horizontal support platform, sand wheel housing being moveable between a raised position and a lowered position in each of which positions said nozzle is respectively in a lowered position or a raised position above the surface to be cleaned, said support platform being fixedly mounted above said lower contiguous portion;

(ii) wheel means rotatably mounted on said lower contiguous portion;

(iii) first abutment means which comprises at least one abutment arm attached to said support platform and fixed in position above said wheel means;

(iv) a handle structure pivotally mounted on said base and moveable between an upper storage position and a lower operating position, said handle structure having a lower portion which comprises a cylindrical housing;

(v) second abutment means attached to said handle structure, said second abutment means comprising at least one protrusion having a substantially flat surface, said at least one protrusion integrally formed as part of the peripheral surface of said cylindrical housing, said at least one abutment arm being attached to said support platform at a predetermined position to engage said at least one protrusion, said support platform being fixed in position by a plurality of supports which are located at the ends of said support platform which are adjacent and distant from said at least one protrusion, said wheel housing being located near said handle structure and said at least one abutment arm extends substantially vertically to engage said at least one protrusion; and, (vi) spring means biasing said wheel housing to said raised position, whereby, as said handle is pivoted from said lower operating position to said upper storage position, said at least one abutment arm engages said at least one protrusion moving said wheel housing from said raised position to said lowered position consequently raising said surface cleaning nozzle to its raised position.

2. A vacuum cleaner comprising:

(i) a base having a surface cleaning nozzle and a wheel housing, said wheel housing having a lower contiguous portion and an upper contiguous portion defining a substantially horizontal support platform, said wheel housing being moveable between a raised position and a lowered position in each of which positions said nozzle is respectively in a lowered position or a raised position above the surface to be cleaned, said support platform having a periphery defining the outer edges of said support platform and being fixedly mounted above said lower contiguous portion by a plurality of supports positioned between said lower contiguous portion and said support platform along said periphery of said support platform;

(ii) wheel means rotatably mounted on said lower contiguous portion;

(iii) first abutment means attached to said support platform and fixed in position above said wheel means;

(iv) a handle structure pivotally mounted on said base and moveable between an upper storage position and a lower operating position, said handle structure having a lower portion which comprises a cylindrical housing, said wheel housing being located near said handle structure;

(v) second abutment means attached to said cylindrical housing, said first abutment means being attached to said support platform at a predetermined position to engage said second abutment means; and, (vi) spring means biasing said wheel housing to said raised position, whereby, as said handle is pivoted from said lower operating position to said upper storage position, said first abutment means engages said second abutment means moving said wheel housing from said raised position to said lowered position consequently raising said surface cleaning nozzle to its raised position.

* * * * *

UNITED STATES PATENT AND TRADEMARK OFFICE

CERTIFICATE OF CORRECTION

PATENT NO. : 5,255,411

DATED : 10/26/93

INVENTOR(S) : Philip Mendes Da Costa

It is certified that error appears in the above-indentified patent and that said Letters Patent is hereby corrected as shown below:

On the title page: Item [75] Inventors: should read --Philip Mendes da Costa --.

Signed and Sealed this

Twenty-eighth Day of December, 1993

*Attest:*

Bruce Lehman

BRUCE LEHMAN

*Attesting Officer*

*Commissioner of Patents and Trademarks*